United States Patent [19]

Spengler

[11] 4,286,490

[45] Sep. 1, 1981

[54] FORCE APPLICATION APPARATUS

[75] Inventor: Ernst M. Spengler, Heusenstamm, Fed. Rep. of Germany

[73] Assignee: Stanztechnik GmbH R & S, Bergen-Enkheim, Fed. Rep. of Germany

[21] Appl. No.: 112,937

[22] Filed: Jan. 17, 1980

Related U.S. Application Data

[63] Continuation-in-part of Ser. No. 965,907, Dec. 4, 1978, abandoned.

[30] Foreign Application Priority Data

| | | | |
|---|---|---|---|
| Jun. 3, 1978 | [DE] | Fed. Rep. of Germany | 2824488 |
| Feb. 2, 1979 | [DE] | Fed. Rep. of Germany | 2903937 |
| Jul. 17, 1979 | [DE] | Fed. Rep. of Germany | 2928785 |
| Aug. 25, 1979 | [DE] | Fed. Rep. of Germany | 2934441 |

[51] Int. Cl.[3] ..... B26F 1/40

[52] U.S. Cl. ..... 83/453; 83/513; 83/517; 83/529; 83/588; 83/639; 83/914; 100/269 A; 254/93 HP; 269/22; 269/25

[58] Field of Search ..... 83/170, 171, 454, 453, 83/461, 465, 513, 516, 517, 518, 519, 529, 588, 590, 639, 914; 100/269 A; 254/93 HP; 269/22, 25; 92/92

[56] References Cited

U.S. PATENT DOCUMENTS

| | | | |
|---|---|---|---|
| 2,380,152 | 7/1945 | David | 254/93 HP |
| 3,230,812 | 1/1966 | Pucci et al. | 83/639 X |
| 3,822,627 | 7/1974 | Bianchi | 83/529 |

*Primary Examiner*—J. M. Meister

*Attorney, Agent, or Firm*—W. G. Fasse; D. F. Gould

[57] ABSTRACT

A force may be applied to any point along a line which may be straight or curved in a plane or in space. For this purpose a force applicator is used which includes a pressure expandable hose section closed at its ends, a reaction member against which the hose rests, and a pressure transmitting plate moving in response to an expansion of the hose. These three elements are held in an operative position relative to one another by a modular frame section which also holds a guide member and a reset element for restoring the hose section to a starting position when no pressure is applied inside the hose. A piston rod extends through the guide member and is operatively connected to the pressure transmitting plate. The modular frame section, the guide member and preferably also the reset element form a modular unit. A plurality of such modular units may be arranged along an elongated hose section, whereby a respectively elongated reaction member and a correspondingly elongated pressure transmitting plate are provided in common for the plurality of modular units. A modular frame section or sections may also be used to hold adjustable stroke limiting elements.

21 Claims, 7 Drawing Figures

FORCE APPLICATION APPARATUS

CROSS REFERENCE TO RELATED APPLICATION

The present application is a continuation-in-part application of my copending application U.S. Ser. No.: 965,907; filed on Dec. 4, 1978, now abandoned.

BACKGROUND OF THE INVENTION

The present invention relates to a force application apparatus which may be longitudinally extended in any desired configuration to apply the force along lines defining such configuration. The present apparatus is particularly suitable for the operating of strip steel knives, for the application of pressure along a line or curve in a plane or in space.

U.S. Pat. No. 3,815,464 discloses a single stroke cutter operated by an expandable hose for severing a seat belt in an emergency. A repeated cutting operation is not possible with this type of structure. The single stroke apparatus is also not suitable for applying the force along a three-dimensional curve.

U.S. Pat. No. 2,363,779 is representative of the prior art in which expandable hose sections are arranged to cover a large surface area corresponding in size, for example, to the surface area of a wall panel which is to be glued together from several panel components.

U.S. Pat. No. 3,822,627 discloses a press which is operated by an inflatable cushion in the form of a membrane. The pressure is applied to the entire surface area and not only along the lines defined, for example, by the configuration of a strip steel knife.

In the prior art it is not possible to assemble the force application apparatus from modular components into modular units which may be arranged and rearranged for applying a force precisely along a line rather than to an entire surface area, whereby the line may be curved in a three-dimensional space.

OBJECTS OF THE INVENTION

In view of the foregoing it is the aim of the invention to achieve the following objects singly or in combination:

- to construct a universally useful force application apparatus which will require a relatively short structural height, as compared to piston cylinder arrangements, and which is not subject to rotation such as a piston might be whereby the apparatus shall be capable of taking up transversely effective forces;
- to provide a force application apparatus capable of applying a force along a line which may be straight or curved in a plane or in space, whereby a repeated operation shall be possible and the modular units shall be useful for repeated rearrangement so that the force may be applied to different configurations;
- to construct a force application apparatus from modular components in such a manner that a plurality of such modular components may be arranged to form force applicator units which are actuated by an expandable hose arranged in common for a plurality of modular force applicator components;
- to construct a force application apparatus from prefabricated modular components which simplify the entire structure as compared to piston cylinder means, and hence also result in a very economical assembly of said prefabricated, modular components into modular units so that mass production techniques may be employed;
- to construct a three-dimensionally effective force application device from modular units capable of operating strip steel knives for cutting car floor carpets, for trimming car dashboards and any other three-dimensional work pieces;
- to construct all modular, prefabricated components so that each component of a modular unit is individually adjustable to avoid jamming or canting of the movable components of the force application apparatus;
- to assemble a plurality of modular units made up of modular components into a three-dimensionally effective force application device;
- to construct guide means for the modular units so that a piston rod guided by the guide means may simultaneously function as a force applicator; and
- to secure tools, such as strip steel knives, to pressure transmission means independently of any guiding means which guide the movement of the pressure transmission means.

SUMMARY OF THE INVENTION

According to the invention there is provided a force application apparatus which comprises a pressure expandable hose, reaction means extending along the hose and connected or connectable to a machine frame. Pressure transmission means extend along the hose substantially opposite the reaction means. The hose, the reaction means, and the pressure transmission means extend through modular frame components which, for example, may be cut from four cornered, tubular, sectional stock. Guide means are operatively held by the modular frame components for guiding the movement of the pressure transmission means. Reset means are operatively interposed between the modular frame components and the pressure transmission means for resetting the pressure transmission means after each work stroke. Force application means are operatively arranged for cooperation with the pressure transmission means. A plurality of modular frame components and the respective guide means form a modular unit or assembly.

The force transmission means may be provided in the form of rods which are guided in guide bushings and which simultaneously carry the tools such as strip steel knives or counter holder means. In an alternative embodiment the guide rods may be arranged independently of the means securing the tools to the pressure transmission means.

BRIEF FIGURE DESCRIPTION

In order that the invention may be clearly understood, it will now be described, by way of example, with reference to the accompanying drawings, wherein.

Figure 4:
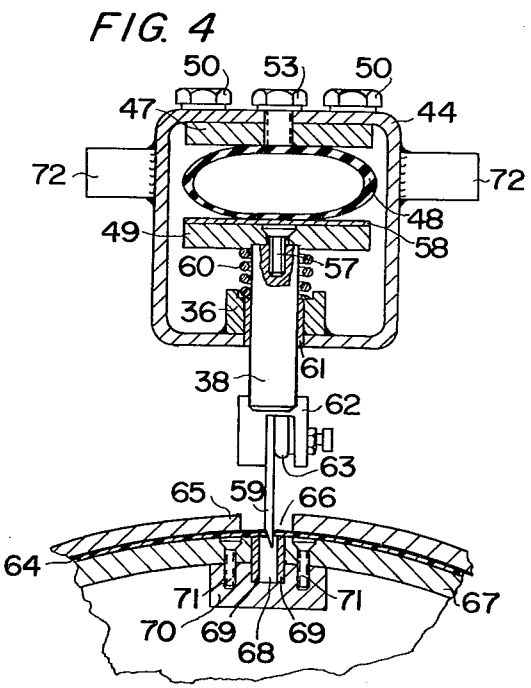
FIG. 4 is a sectional view along section line 4—4 in FIG. 3.
Figure 3:
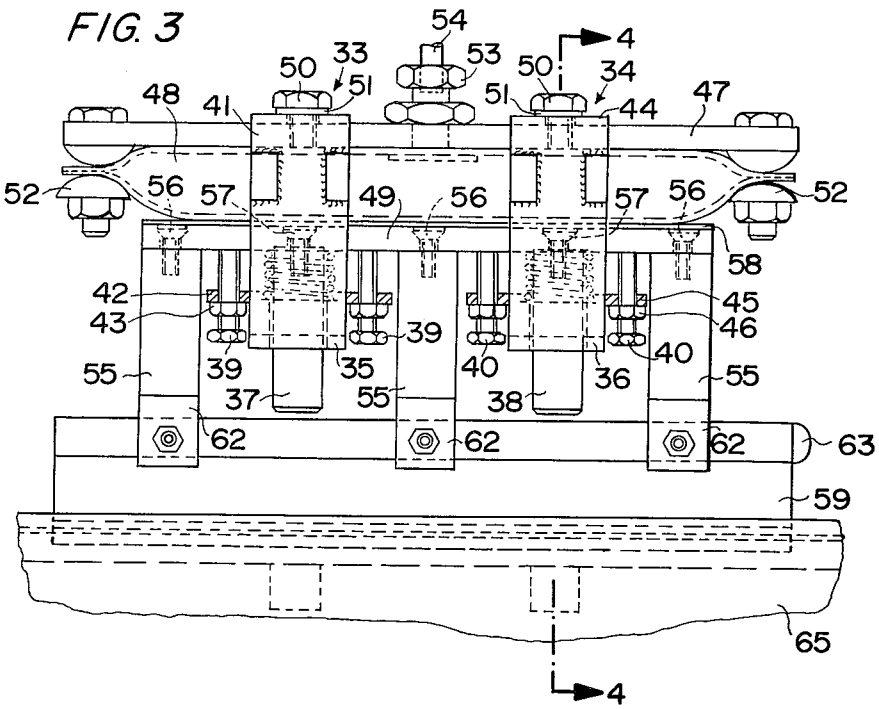
FIG. 3 is a side view similar to that of FIG. 1 in which a strip steel knife is secured to the pressure transmission means independently of the guide means and in which the stroke limiting means are connected to the modular support frame components.
Figure 6:
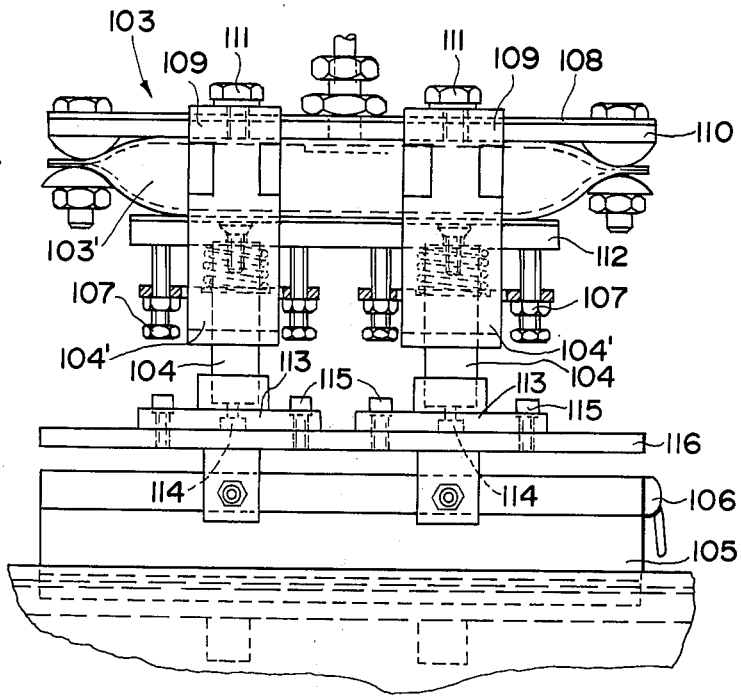
Figure 7:
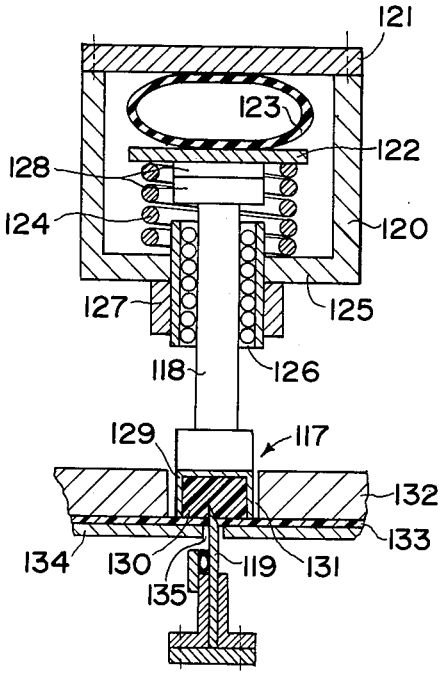

FIG. 6 is a side view similar to that of FIG. 3 however, with a strip steel knife directly connected to the guided rods which thus simultaneously form the force transmission means; and FIG. 7 is a sectional view similar to that of FIG. 4, however, showing further details of a guide bushing and wherein the force applicator is constructed as a counter holder means, for example, for a stationary strip steel knife.

DETAILED DESCRIPTION OF PREFERRED EXAMPLE EMBODIMENTS AND OF THE BEST MODE OF THE INVENTION

Figure 1:
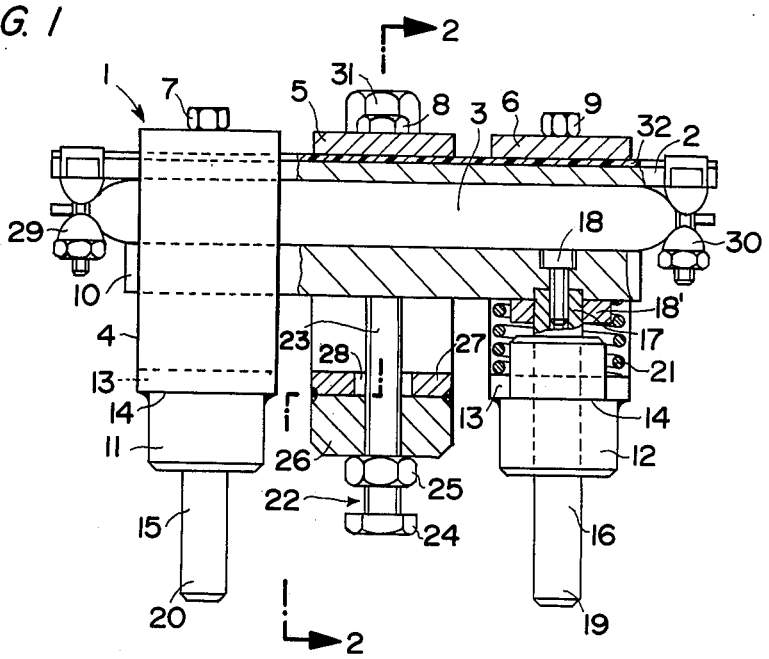
FIG. 1 is a side view of a force application apparatus according to the invention partially in section and comprising three modular frame components, two of which are support elements and one of which holds stroke limiting means.

The work applying apparatus 1 of FIG. 1, comprises a reaction means 2 such as a steel bar operatively connected to a machine frame not shown. An elastically expandable hose 3 rests against the reaction member 2. The shape of the reaction member 2 is adapted to the individual requirements of the particular type of force application. Three modular frame components 4, 5 and 6 are operatively secured to the reaction member 2 by adjustable screws 7, 8, and 9 respectively. For this purpose the reaction member 2 is provided with respective threaded holes at spaced intervals so that the modular frame components may be also spaced from each other to form a modular unit also referred to as work application apparatus 1.

Figure 2:
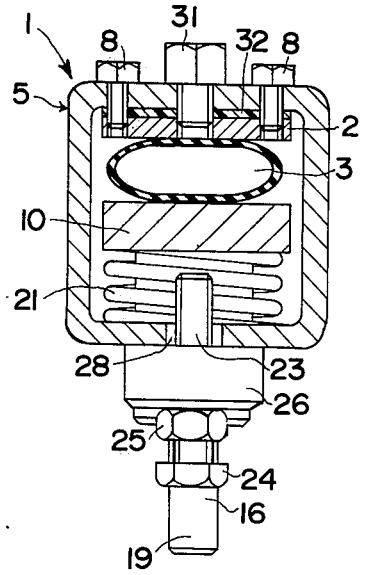
FIG. 2 is a sectional view along section line 2—2 in FIG. 1.

The modular frame components 4, 5, and 6 may be cut as relatively short sections from tubular sectional stock such as a four cornered pipe of rectangular or square cross section. The frame components 4 and 6 support a pressure transmission means such as a longitudinal steel plate 10 which rests longitudinally against the hose 3 substantially opposite the reaction bar 2. Further, the frame components 4 and 6 support guide bushings 11 and 12 for guiding the movement of the pressure plate 10. The guide bushings 11 and 12 are rigidly secured, for example, by welding to the lower legs or cross ties of the modular frame components 4 and 6. The guide bushings 11 and 12 have a shoulder 14 which rests against the respective cross tie 13. Further, each guide bushing 11, 12 has an upper end of smaller diameter which extends into the respective modular frame component 4 and 6. Each guide bushing is provided with a longitudinal, axial bore which forms a sleeve guide bearing for guide rods 15 and 16 which simultaneously serve as force applying piston rods. The upper end 17 of each guide rod 15, 16 is rigidly secured to the pressure plate 10, for example, by screws 18 and by a ring member 18'. Thus, the rods 15, 16 will move up and down with the movement of the pressure plate 10 in response to the expansion of the hose 3 and guided in the longitudinal bores of the respective guide bushing 11, 12. A tool, not shown in FIGS. 1 and 2, may be operatively secured to the lower ends 19 and 20 of the rods 15 and 16. A plurality of holes may be arranged in a row in the pressure plate 10 through which the screws 18 may extend. Thus, by loosening the screws 18 the frame components 4, 6 may be adjusted into any position along the length of the pressure plate 10.

Reset means such as a spring 21, are arranged between the pressure plate 10 and the inwardly facing surface of the cross tie 13.

The spring 21 is operatively held in position by the narrower diameter upper end of the respective guide bushing 11, 12 and by the respective ring 18'. The ring 18' and the upper end of the guide bushing are sufficiently spaced from each other so as not to interfere with the work stroke. In the position shown in FIG. 1 the hose 3 is expanded to its maximum extent and the spring 21 will return the pressure plate 10 and the hose 3 into a rest position as soon as the pressure is released from the hose 3, whereby the pressure medium is removed from the hose 3 by the force of the springs 21.

The further modular frame member 5 carries a stop means 22 for limiting the maximum stroke of the pressure plate 10.

For this purpose a screw 24 extends through a threaded block 26 which may be welded to the lower cross tie 27 of the frame component 5. The screw 24 extends with its upper free end 23 through a hole 28 in the cross tie 27 and cooperates with a counter nut 27 for adjusting the position of the free end 23 relative to the pressure plate 10, and thereby the length of the stroke.

The hose 3, the reaction bar 2, and the pressure plate 10 extend through all frame components 4, 5, and 6 and the ends of the hose 3 are closed by clamping elements 29 and 30. A pressure medium may be supplied into the hose 3 and removed from the hose 3 through a connecting nipple 31. The source of pressure may be pneumatic or hydraulic.

The force application modular unit 1 is particularly suitable for applying pressure forces along a line. In this connection it is especially advantageous that the direction of force application, namely, the direction of movement of the rods 15 and 16 extends perpendicularly to the longitudinal axis of the hose 3. The length of the hose 3, the reaction take up bar 2 and the pressure plate 10 may be selected to accommodate any individual requirements. The number of modular subassemblies which are distributed along the length of the elements 2, 3, 10 will depend on the length of the just mentioned elements. Each subassembly is constructed exactly like any other subassembly and comprises the modular frame component 4, 6 with the guide bushing 11, 12, with the respective guide rod 15, 16 and the reset spring 21. The additional subassemblies with the modular frame components 5 are also constructed in exactly the same manner and the frame components may be cut from the same tubular stock. Thus, these modular units may be produced by mass production techniques, thereby greatly economizing the production costs.

Another important advantage of the invention is seen in that each individual subassembly may be separately secured to and adjusted on the reaction bar 2, whereby a proper parallel guide through the bushings 11, 12, and the guide rods 15, 16 is accomplished. It has been found to be advantageous for said parallel guiding to insert an elastic rubber type washer 32 between the frame components and the reaction bar 2. Due to the elasticity of the intermediate washer 32 the guide bushings 11, 12 with the respective guide rods 15, 16 always take up a position so that the guide surfaces extend at right angles to the longitudinal axis of the hose 3 and thus assuring the necessary parallel guide.

Incidentally, the reset spring 21 may also be inserted in the modular frame component 5 around the limit screw 23.

The present apparatus is suitable wherever it is necessary to apply a force or where a tool or machine component is required to be adjusted or to make a relatively short movement. The modular units may be distributed in any desired configuration or shape, for example, along a three-dimensional curve and there are substantially no limitations to the length of the apparatus because any number of modular units may be assembled in a row.

It has been found that, for example, for transmitting a pressure of six tons along a line having a length of 1 m, the costs for the required number of conventional piston cylinder force applicators would be about ten times the costs for the required number of force applicator units according to the invention. Moreover, the structural height has been reduced substantially, namely, to about 30% as compared to the structural height required for piston cylinder force applicators. Another substantial advantage of the invention is seen in the arrangement which permits moving tools through a work piece and through upper and lower molds simultaneously in opposite directions from opposite surfaces of the work piece substantially without interference between the simultaneous or sequential operation of the modular units.

FIG. 3 illustrates a view similar to that of FIG. 1, however in FIG. 3 there are two subassemblies 33 and 34 which simultaneously carry the guide bushings 35 and 36 as well as the guide rods 37 and 38 and the stroke limiting means 39 and 40. The stoke limiting means 39 are secured to the frame component 41 by a bracket 42 and cooperate with counter nuts 43. The stroke limiting means 40 are secured to the modular frame component 44 by a bracket 45 and cooperate with adjustment counter nuts 46.

As in FIG. 1, the reaction bar 47 extends along one side of the hose 48. The other side of the hose extends along the pressure transmission plate 49. The modular frame components 41 and 44 are adjustably secured to the reaction bar 47 by screws 50 including lock washers 51. Both ends of the hose 48 are closed by clamping means 52. A pressure medium is admitted into the hose 48 and removed from the hose 48 through a connector 53 which may cooperate with a flexible conduit 54.

The pressure plate 49 is secured to force transmission bars 55 by screws 56. The pressure plate 49 is further secured to the guide rods 37 and 38 by screws 57. A cover plate 58 covers the heads of the screws 56, 57. In FIG. 3 the guide rods 37 and 38 are independent of the force transmission bars 55. However, the operation is the same in both embodiments because the expansion of the hose 48 is transmitted as a vertical up and down movement of the bars 55 to a tool such as a strip steel knife 59 and the parallel movement is rigidly enforced by the guide bushings 35, 36 and the respective guide rods 37, 38. The resetting is accomplished, just as in FIG. 1, by a resetting spring 60 best seen in FIG. 4. A friction reducing liner 61 is preferably inserted into the guide bushings 35, 36, thereby improving the operation of the guide bushing as an axial sleeve bearing.

The strip steel knife 59 is secured to the bars 55 by clamping means 62 of conventional construction. An electrical heating conductor 63 may be arranged along the strip steel knife 59 as is conventional to preheat the knife depending on the type of work piece 64 to be cut by the knife 59.

Incidentally, in FIG. 1 it is possible to use guide rods 15, 16 of different lengths and in FIG. 3 the bars 55 may have different lengths, whereby the tool to be attached to the rods 15, 16 or to the bars 55 may have a curved shape.

Referring to FIG. 4 the present tool with its strip steel knife 59 cooperates with an upper mold 65 having a gap 66 therein through which the knife 59 extends. The work piece 64 is held between the upper mold 65 and a lower mold 67. The lower mold may be supported on a lifting table or the like not shown. The upper mold 65 operates as a hold down member. Both molds conform to the desired shape of the work piece. The lower mold 67 is also provided with a gap 68 which is lined by steel strips 69 held in position by a channel member 70 secured by screws 71 to the lower mold 67. Incidentally, the molds 65 and 67 may be made of fiberglass or the like.

In operation, the strip steel knife 59 penetrates through the work piece 64 in response to the pressurization of the hose 48 thereby moving through the gap 66 and into the gap 68 since the work piece 67 is stretched across the gap 68. Thus, the knife 59 does not cooperate with a counter holding means in the embodiment of FIG. 4, but rather with the relatively narrow gaps 66 and 68. The upper mold 65 and the lower mold 67 are thus greatly relieved of forces resulting from the cutting operation and therefore may be of relatively light construction.

The modular frame components 41, 44 may be held in a machine frame not shown, by means of bars 72 welded to the modular frame components and preferably secured to a machine frame by conventional means such as position adjustable clamps or the like.

Figure 5:
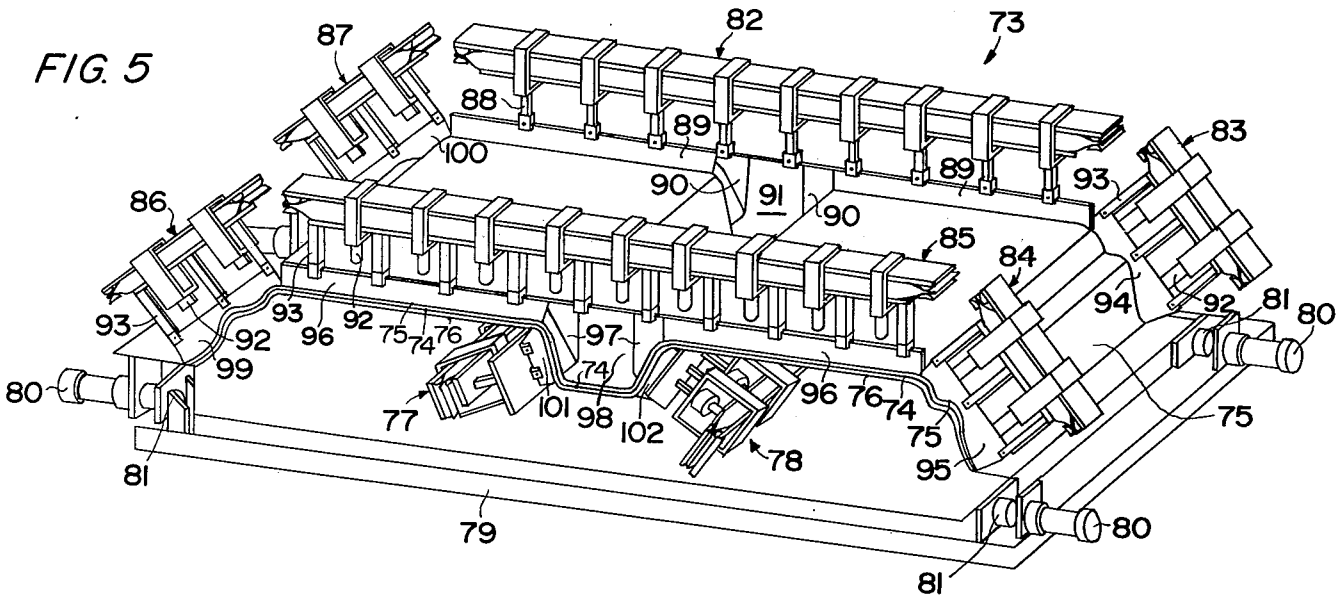
FIG. 5 is a perspective view of a plurality of modular force application units to form a three-dimensionally effective tool, for example, for the cutting of vehicle floor carpeting.

FIG. 5 shows a perspective view of a three-dimensional cutting or trimming tool assembly. Features not essential for the illustration have been omitted. Thus, the machine frame, the pressure supply means, and similar components have been omitted from FIG. 5 to facilitate the illustration of the features which are necessary to show the three-dimensional arrangement of a total of ten modular assemblies according to the invention for cutting a work piece 74 such as a floor carpet for a vehicle. Only eight of the modular assemblies are seen in FIG. 5. The two additional assemblies are not seen in FIG. 5 because they are below the work piece and back of the two assemblies shown in FIG. 5 below the work piece. The work piece is held in position between an upper mold 75 and a lower mold 76. The molds may be made of fiberglass to have the contour required for the work piece.

The lower mold 76 and the modular units 77 and 78 which are arranged inside the mold 76 are operatively supported on a lifting table 79 by conventional means. The raising and lowering of the lifting table 79 may be accomplished by mechanical, hydraulic, or pneumatic means. The lower mold 76 and the modular tool units 77 and 78 are raised and lowered together with the table 79. Locking piston cylinder means 80 are rigidly secured to the machine frame not shown and cooperate with locking means 81 forming part of the lifting table for locking the lifting table to the machine frame in an operating position. Such locking has the advantage of transmitting reaction forces into the machine frame so that they do not have to be taken up by the lifting table.

The upper mold 75 and six modular force application units or assemblies 82 to 87 are supported in an upper portion of a machine frame or in a separate frame structure which may be exchangeable or which may also be movable up and down by conventional means relative to the lower tool structure 76, 77, 78, 79.

The force application assembly 82 is of the type shown in FIG. 1 wherein the rods 88 simultaneously function as force transmission rods and as guide rods. The rods 88 carry strip steel knives 89 and counter holder means 90 as well as an extended knife 91. The assemblies 83, 84, 85, 86, and 87 are of the type shown in more detail in FIG. 3 in which the guide rods 92 are separate from the force transmission bars 93. Basically, any type of assembly as disclosed herein may be combined in a three-dimensionally effective tool with any other type of assembly disclosed herein. The assembly 83 carries a strip steel knife 94 which is cooperating with a gap as shown in FIG. 4. The assembly 84 carries a strip steel knife 95 operating in the same manner as the knife 94.

The assembly 85 carries strip steel knives 96, counter holder means 97, and an extended knife 98. The assembly 86 carries a knife 99 and the assembly 87 carries a knife 100. The assembly 77 carries a knife 101 cooperating with one of the counter holders 97. A typical counter holder is shown in FIG. 7 and will be described in more detail below. The assembly 78 carries a knife 102 cooperating with the other counter holder 97.

The strip steel knives are arranged in such a manner that a continuous line of cut is accomplished in accordance with the three-dimensional shape of the work piece 74. The upper and lower molds are provided with gaps for the passage of the knives as described above with reference to FIG. 4 so that the various tools or knives may be effective through the molds from opposite sides thereof and the operation of the knives may be controlled to be simultaneous or in sequence, whereby an interference of tools is positively avoided. The supporting of the various tool assemblies will normally be such that the direction of knife movement is substantially perpendicular to the surface of the work piece at that point. However, the present knives are effective even if they are arranged at an angle relative to the work piece surface as may be necessary depending on the shape of the work piece. Further, the present assemblies may carry different tools simultaneously. Thus, as mentioned, the assemblies 82 and 85 carry simultaneously different types of knives and counter holders. The securing of the various assemblies to the lifting table 79 and to the machine frame may be accomplished by adjustable clamping means which are conventional in the art.

It is an advantage of the invention that the assembly may be made to any desired length and may be assembled to extend around corners and curved work pieces. The adaptation of the positioning of the tool assemblies to the requirements of the work piece shape is substantially simpler than in the prior art which uses piston cylinder arrangements.

FIG. 6 shows a modification of the assemblies shown in FIGS. 3 and 4. In FIG. 6 the assembly 103 comprises rods or bars 104 which serve simultaneously as guide rods and as force transmission rods since the bars 104 extend through guide bushings 104'. These rods may have different lengths so as to accommodate a curved strip steel knife 105. Incidentally, the strip steel knives may have serrated cutting edges as is known in the art and they may be heated by an electric heater 106 as has been described above.

The reset means and the stroke limiting means 107 are substantially the same as in FIG. 3. An elastic washer layer 108 may be inserted between the modular frame components 109 and the reaction bar 110 and the position of the modular frame components 109 is adjustable by screw 111 as described. The stroke limiting means 107 cooperate with the pressure transmission plate 112. The embodiment of FIG. 6 has the advantage that separate stroke limiting frame means as shown in FIG. 1 and also separate force transmitting bars as shown in FIG. 3 are avoided, whereby a very compact assembly is achieved including the expansion hose 103'.

The force transmission and guide bars 104 are operatively connected to the knife 105 through sockets 113 and screws 114 which secure the socket 113 to the lower ends of the rods 104. Additional screws 115 connect the socket 113 to an intermediate bracket 116 which in turn is conventionally connected to the strip steel knife 105, for example, in a manner as shown in FIG. 4.

FIG. 7 is a sectional view similar to that of FIG. 4, however the tool 117 attached to the force transmitting rod 118 which functions simultaneously as a guide rod, is a counter holder cooperating with a knife 119 which may be stationary or movable.

The modular frame component 120 is cut as a relatively short piece from sectional steel having a U-channel cross-section. A plurality of such modular frame components 120 are operatively secured to a longitudinal reaction bar 121. The pressure transmission plate 122 is operatively secured to the upper end of the force transmission rod 118. The pressure transmission plate 122 will have a length substantially corresponding to that of the reaction bar 121 and of the hose 123. A reset spring 124 is operatively inserted between the lower cross tie 125 of the modular frame component 120 and the pressure transmission plate 122.

The rod 118 is guided by a guide bushing 126, for example, in the form of a ball box or the like. The ball box 126 is in turn properly held in position by a sleeve 127 welded to the tie 125. The stroke may be limited by one or several washers 128 at the upper end of the rod 118 placed there prior to the assembly of the entire unit. The washer means 128 cooperate with the upper end of the ball box 126 thereby limiting the downward expansion of the hose 123.

The counter holder tool 117 may comprise a longitudinal U-shaped channel member 129 secured to the lower end of the rod 118 and holding a replaceable strip of plastic material 130 such as TEFLON (Registered Trademark) or the like. The counter holder extends, for example, through a gap 131 in an upper mold or hold down member 132 which presses the work piece 133 against the lower mold 134 which is also provided with a gap 135 through which the knives 119 extend.

In the light of the above disclosure it is clear that the assembly is greatly simplified. For example, only alignment of a minimum number of components with the respective holes is necessary. Thus, the registering of a plurality of holes to be aligned has been avoided according to the invention.

Although the invention has been described with reference to specific example embodiments, it will be appreciated, that it is intended, to cover all modifications and equivalents within the scope of the appended claims.

What is claimed is:

1. A modular force application apparatus, comprising an opensided modular bail having a central axis, pressure expandable hose means (3) extending through said bail substantially along said central axis, a pressure transmission means located in said bail for a back and forth movement substantially perpendicularly to said central axis but restrained by the bail against rotation, said pressure transmission means contacting said hose means whereby said bail takes up a reaction force, guide bushing means rigidly secured to said bail, a guide rod extending into the guide bushing means and rigidly secured to said pressure transmission means for guiding the back and forth movement of said pressure transmission means, reset means operatively interposed between said bail and said pressure transmission means for resetting the pressure transmission means when pressure is released from said hose means and force applying means operatively arranged for movement in the same plane as said guide rod and for cooperation with said pressure transmission means to avoid canting of said pressure transmission means, said bail and said guide means forming a modular unit, whereby a plurality of such bails may be spaced along said expandable hose means.

2. The apparatus of claim 1, wherein said reset means also form part of said modular unit.

3. The apparatus of claim 1 or 2, wherein a plurality of said modular units are arranged around said pressure transmission means, and around said pressure expandable hose means which are provided in common for said plurality of said modular units which are spaced from one another.

4. The apparatus of claim 1, further comprising machine frame means and securing means for adjustably securing said bail to said machine frame means.

5. The apparatus of claim 1, further comprising a reaction force take-up member operatively connected to said bail and elastically yielding insert means operatively interposed between said bail and said reaction force take-up member for facilitating the linear guiding of said guide rod.

6. The apparatus of claim 1, further comprising modular stroke limiting means including a further modular bail of substantially the same construction as said first mentioned modular bail, and adjustable means operatively supported for cooperation with said pressure transmission means to limit the stroke applying movement of said pressure transmission means.

7. The apparatus of claim 6, wherein at least two of said modular units are arranged along said hose means, along said pressure transmission means and wherein one of said modular stroke limiting means is operatively arranged intermediate said two modular units.

8. The apparatus of claim 1 or 6, wherein said modular bail and said further modular bail are sections cut off from rectangular or square sectional tubular stock.

9. The apparatus of claim 1 or 6, wherein said modular bail and said further modular bail are sections cut off from sectional stock.

10. The apparatus of claim 1, comprising at least two bails of the same construction and means for separately and adjustably positioning said bails along said hose means.

11. The apparatus of claim 1, wherein said bail comprises an upper cross piece, two side legs extending from said upper cross piece and lower tie means rigidly connecting the two side legs, said apparatus further comprising reaction means and first means securing said cross piece to said reaction means, said guide bushing means being operatively secured to said lower tie means, said force applying means comprising a guide rod extension extending entirely through said guide bushing means and thus through said lower tie means whereby said guide rod extension provides an outer force applying end.

12. The apparatus of claim 1, further comprising adjustable stop means arranged for cooperation with said pressure transmission means for limiting the work stroke of said force applying means.

13. The apparatus of claim 1, wherein said force applying means comprise bar means connected to said pressure transmission means, said apparatus further comprising tool means and means operatively connecting said tool means to said bar means.

14. The apparatus of claim 11, wherein said guide rod with its extension simultaneously performs a guiding function and a force transmission function.

15. The apparatus of claim 1, further comprising in addition to said guide rod extending into said guide bushing means for a linear movement in the direction of the longitudinal axis of said guide rod, tool means (59), and means operatively connecting said tool means (59) to said force applying means (55, 62, 63) cooperating with said pressure transmission means (10).

16. The apparatus of claim 1, wherein a plurality of said modular units with the respective hose means, and pressure transmission means are assembled to form three-dimensionally operative force application means comprising upper force application units and lower force application units, said upper force application units being located above a work piece, said lower force application units being located below said work piece.

17. The apparatus of claim 16, further comprising upper mold means and lower mold means, said upper and lower force application units being arranged to be effective through said upper and lower mold means.

18. The apparatus of claim 17, wherein said upper mold means and said lower mold means comprise gaps therein, said force application units being effective through said gaps.

19. The apparatus of claim 16, further comprising counter holder means and means operatively connecting said counter holder means to at least certain of said force application units.

20. The apparatus of claim 19, wherein said counter holder means comprise bars of synthetic material arranged along lines substantially coinciding with the effectiveness of said force application units.

21. A force application module, comprising a substantially closed bail having a central axis and open sides, said central axis extending substantially perpendicularly through said open sides, expandable hose means extending through the open sides of said bail so that the bail surrounds the expandable hose means whereby a plurality of such bails may be spaced along said expandable hose means, force transmitting means including a pressure plate operatively arranged in the bail in parallel to the hose means whereby the bail permits back and forth movement of the pressure plate inside the bail in a central plane perpendicularly to said central axis and substantially restrains any other movement of the pressure plate, guide bushing means having a longitudinal axis extending substantially perpendicularly to said central axis, said force transmitting means further comprising guide rod means extending through said guide bushing means substantially perpendicularly to said central axis, said guide rod means having an outer end extending out of the guide bushing means and thus out of the bail and an inner end extending into the bail, means rigidly securing said inner end of said guide rod means to said pressure plate whereby the guide rod means performs the function of force transmission and simultaneously a guiding function by its movement in said central plane to avoid canting of the force transmitting means, and reset means operatively interposed between the bail and the force transmitting means for resetting the force transmitting means into a starting position when a pressure is released from said expandable hose means.

* * * * *